US006142824A

United States Patent [19]

Savoca et al.

[11] Patent Number: 6,142,824

[45] Date of Patent: Nov. 7, 2000

[54] SUSPENSION CONNECTOR ASSEMBLY HAVING OVER-TRAVEL MALE CONTACT MEMBERS

[75] Inventors: Paul F. Savoca, West Bay Shore; John P. Sclafani, Bating Hollow, both of N.Y.

[73] Assignee: Duraline, a division of J. B. Nottingham Co., Inc., Central Islip, N.Y.

[21] Appl. No.: 09/016,420

[22] Filed: Jan. 30, 1998

[51] Int. Cl.[7] ..... H01R 13/60

[52] U.S. Cl. ..... 439/531; 439/531; 439/693; 439/936

[58] Field of Search ..... 439/693, 531, 439/692, 695, 936

[56] References Cited

U.S. PATENT DOCUMENTS

| | | | |
|---|---|---|---|
| 4,299,431 | 11/1981 | Wilson et al. | 339/60 |
| 5,120,237 | 6/1992 | Fussell | 439/282 |
| 5,167,518 | 12/1992 | Deacon | 439/188 |
| 5,383,790 | 1/1995 | Kerek et al. . | |
| 5,393,245 | 2/1995 | Hinds, Jr. . | |

OTHER PUBLICATIONS

Brochure/Advertisement For Lighting & Lowering Systems, Model SCU–1A Dated Oct. 1993.

Brochure Advertisement For Lighting & Lowering Systems, Model SCU–2A Dated Oct. 1993.

Brochure Advertisement For Lighting & Lowering Systems, Model SCU–2X Dated Nov. 1993.

Brochure For Lowering Systems, Inc.

Brochure/Advertisement For Design HMSP, Section 300 p. 11.

Brochure/Advertisement For Lighting & Lowering Systems, "How It Works", Dated Jan. 1994.

Brochure/Advertisement For Suspension Contact Units, Model SCU–1.

*Primary Examiner*—Paula Bradley
*Assistant Examiner*—Truc Nguyen
*Attorney, Agent, or Firm*—Nixon Peabody LLP; Thomas W. Cole

[57] ABSTRACT

A suspension connector assembly is provided that includes a female connector mounted within a stationary housing that includes a conductive barrel contact surrounded and resiliently supported by an electrically insulative plug body, a movable male connector adapted to be raised toward and lowered away from the female connector that includes a pin contact member having a conductive end insertable within the female barrel contact, and a cam-type latching mechanism for joining the female and male connectors when they are mutually engaged. The length of the male contact member is extended to include an over-travel portion that maintains the conductive end of the pin within the barrel contact of the female connector after the male connector separates a short distance away from the female connector incident to a latching operation. The over-travel portion of the male pin is insulated such that all exposed current-carrying components of the connector assembly are not only electrically insulated, but isolated from potentially corrosive ambient air and moisture.

17 Claims, 6 Drawing Sheets

SUSPENSION CONNECTOR ASSEMBLY HAVING OVER-TRAVEL MALE CONTACT MEMBERS

BACKGROUND OF THE INVENTION

This invention generally relates to suspension connector assemblies of the type used, inter alia, in mast-supported street lighting systems, and is specifically concerned with a suspension connector assembly utilizing insulated female barrel connectors in combination with extended length male contact members capable of maintaining contact within the barrel connectors throughout the stroke of a reciprocating latch mechanism.

Suspension connector assemblies for mast-supported street lights are well known in the prior art. Such assemblies allow the bulbs of the street light to be changed without the need for a cherry-picker truck to lift a man to the top of the support mast. The electrical connectors used in these devices generally comprise two or more female spring clip connectors mounted within a stationary bell-shaped housing which in turn is secured onto the arm of the support mast. The street lights are screwed into a movable fixture having two or more prong-type male connectors that are receivable within the female spring clip connectors. The light fixture and male connectors may be lifted and lowered with respect to the arm-mounted female connector by means of a cable connected to a hand-cranked wench located at the base of the mast. A reciprocating, cam-type latching mechanism is provided between the male and female connectors for latching and unlatching them whenever the male connector is moved into engagement against the female connector for a predetermined distance (referred to hereinafter as the latching stroke distance).

When it becomes necessary to change a burned-out bulb or to perform some other maintenance operation on the light fixture, the system operator first obtains access to the wench stored in the hollow base section of the mast. The wench is then cranked so that the cable pulls the male connectors against the female connectors thereby unlatching the cam-operated latching mechanism. The operator then unwinds the reel of the wench. The weight of the light fixture is greater than the frictional force between the prongs of the male connector and the spring clips of the female connectors. Consequently, the prongs of the male connectors will withdraw from the female connectors. The operator can then gently lower the light fixture by unreeling the cable of the wench. After the light fixture has been lowered to a convenient height, the bulb replacement or other maintenance operation is performed. The light fixture may then be raised via the cable of the hoisting mechanism to re-insert the male prongs into the female connectors and to re-latch the latching mechanism.

While such prior art connector assemblies have proven to operate satisfactorily in the field, the inventor has observed a number of shortcomings associated with the prong and spring clip connector design that limits their usefulness. For example, the exposed metal surfaces of both the clip-type female connectors and the prong-type male connectors create an electrical shock hazard, as it is possible for wet debris to become lodged within the bell-shaped housing and conduct electricity from the connectors to the metal bell housing and mast of the street light. Additionally, the exposure of these current-carrying metallic surfaces to ambient air and moisture promotes corrosion which can interfere with the reliability of the electrical contact surfaces and shorten the life span of the connectors. The resiliency of the clip-type connectors is apt to weaken over time, further compromising the reliability of the electrical connection made. The combination of corrosion and weakening of the spring clips can cause arcing which can exacerbate the aging of the connectors. Worse yet, if one attempts to use such a suspension connector assembly to power a surveillance video camera, instead of a light bulb, such arcing can seriously interfere with the reliable operation of such devices, and possibly damage the relatively sensitive circuits used in such devices.

Clearly, there is a need for an improved suspension connector assembly having a safer and more reliable connector structure. Preferably, the connectors should operate in a substantially arc-free manner over time so that the connector assembly will be suitable for use not only with light fixtures, but with sensitive informational devices such as video surveillance cameras. Finally, the connectors used in such a suspension connector assembly should have a high degree of longevity to reduce the need for repair or replacement of connector parts over time, and should be compatible for use with standard, commercially-available latching mechanisms.

SUMMARY OF THE INVENTION

Generally speaking, the invention is an improved suspension connector assembly that overcomes or at least ameliorates all of the aforementioned shortcomings associated with the prior art. The suspension connector assembly comprises a female connector mounted within a stationary housing that includes an electrical contact element, a movable male connector adaptable to be raised toward and lowered away from the female connector and including a contact member having a conductive end portion insertable within the female contact element, and a latching member for joining the connectors when they are mutually engaged. The male contact member is of extended length and includes an over-travel portion for maintaining the conductive end portion within the female contact element after the male connector falls away from the female connector a latch stroke distance.

The female connector includes an electrically insulative plug body that surrounds and resiliently supports the female contact element and which also functions to isolate the female contact element from ambient moisture. The plug body further includes an opening for receiving the male contact member, and a seal surrounding the opening for sealing out ambient air and moisture when the male contact member is disposed within the female connector.

The over-travel portion of the male contact member is substantially the same length as the latch stroke distance, and is insulated so that no electrically conductive surfaces are exposed either during or after a latching operation between the male and female connectors. Additionally, the male contact member is preferably a cylindrical pin and the female contact element is preferably a resilient conductive barrel to insure a positive electrical connection between the contact element and member when the male and female connectors are joined.

The male connector may include a plug member formed from a synthetic rubber, and the over-travel portion of the male contact member may be insulated with a sleeve of the same synthetic rubber forming the male plug member which is integrally connected thereto. Of course, the female connector may include multiple barrels and the male connector may include multiple pins to accommodate a plurality of different electrical circuits.

The provision of an over-travel portion in the male member provides a suspension connector assembly of simplified structure which is compatible for use with commercially available latching mechanisms in which the male connector separates from the female connector a latch stroke distance incident to a latching operation. The provision of an electrically insulative plug body and plug member for the female and male connectors in combination with the insulated nature of the over-travel portion of the male member insures that no current-conducting portion of the connector assembly is exteriorally exposed during or after a latching operation, thereby enhancing the safety of the assembly. The fact that the plug body and male contact member cooperate to seal out ambient air and moisture, protract the life of the current-carrying components by insulating them from corrosion-promoting conditions. Finally, the resilient support given to the barrel-type connectors by the resilient, synthetic rubber plug body of the female connector further extends the life of the connector and discourages arcing, thereby rendering the connectors compatible for use with sensitive electronic equipment such as video surveillance cameras.

DETAILED DESCRIPTION OF THE PREFERRED EMBODIMENT

Figure 1:
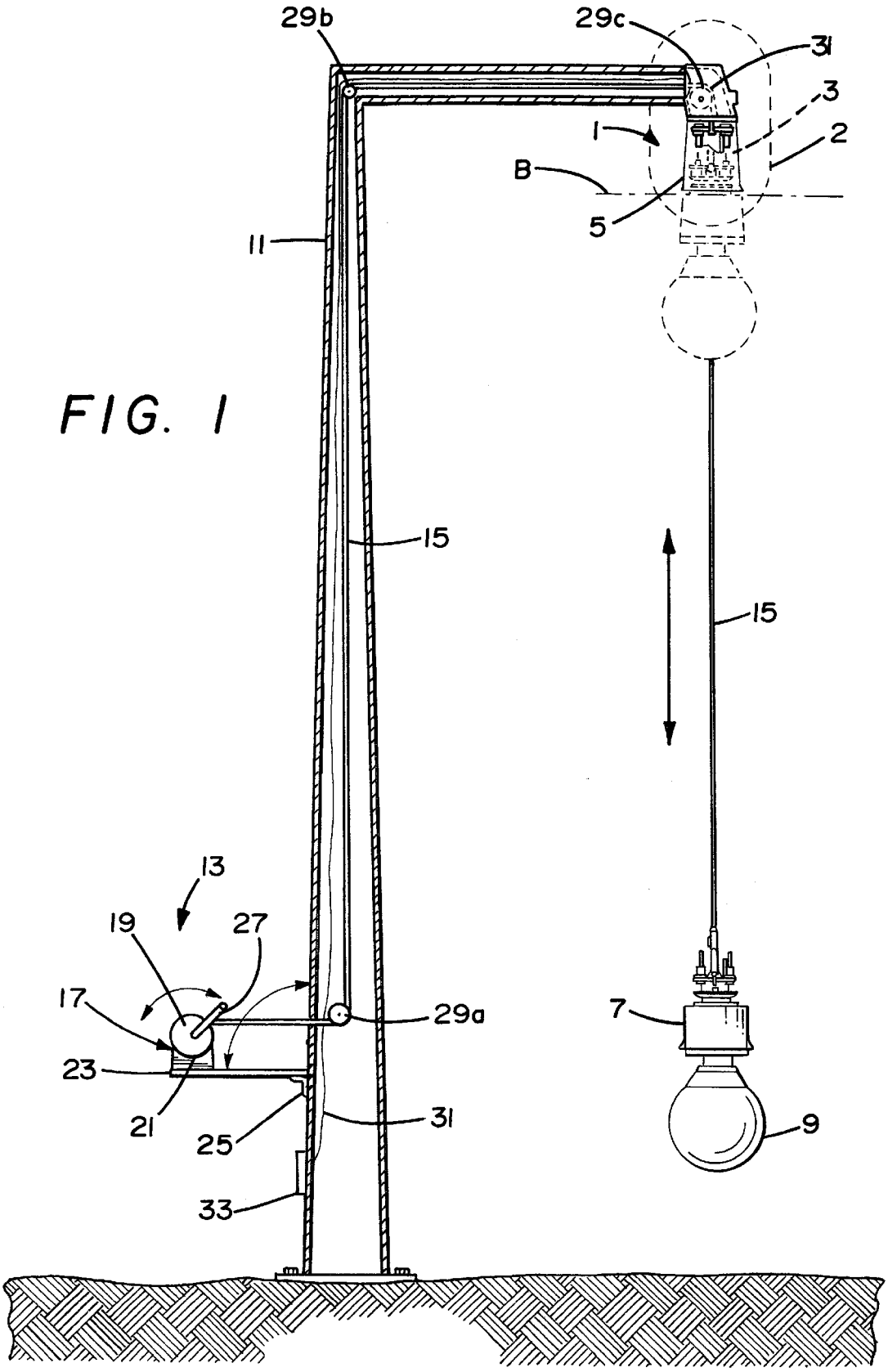
FIG. 1 is a cross-sectional side view of the suspension connector assembly of the invention in combination with a mast and hoisting mechanism.
Figure 2:
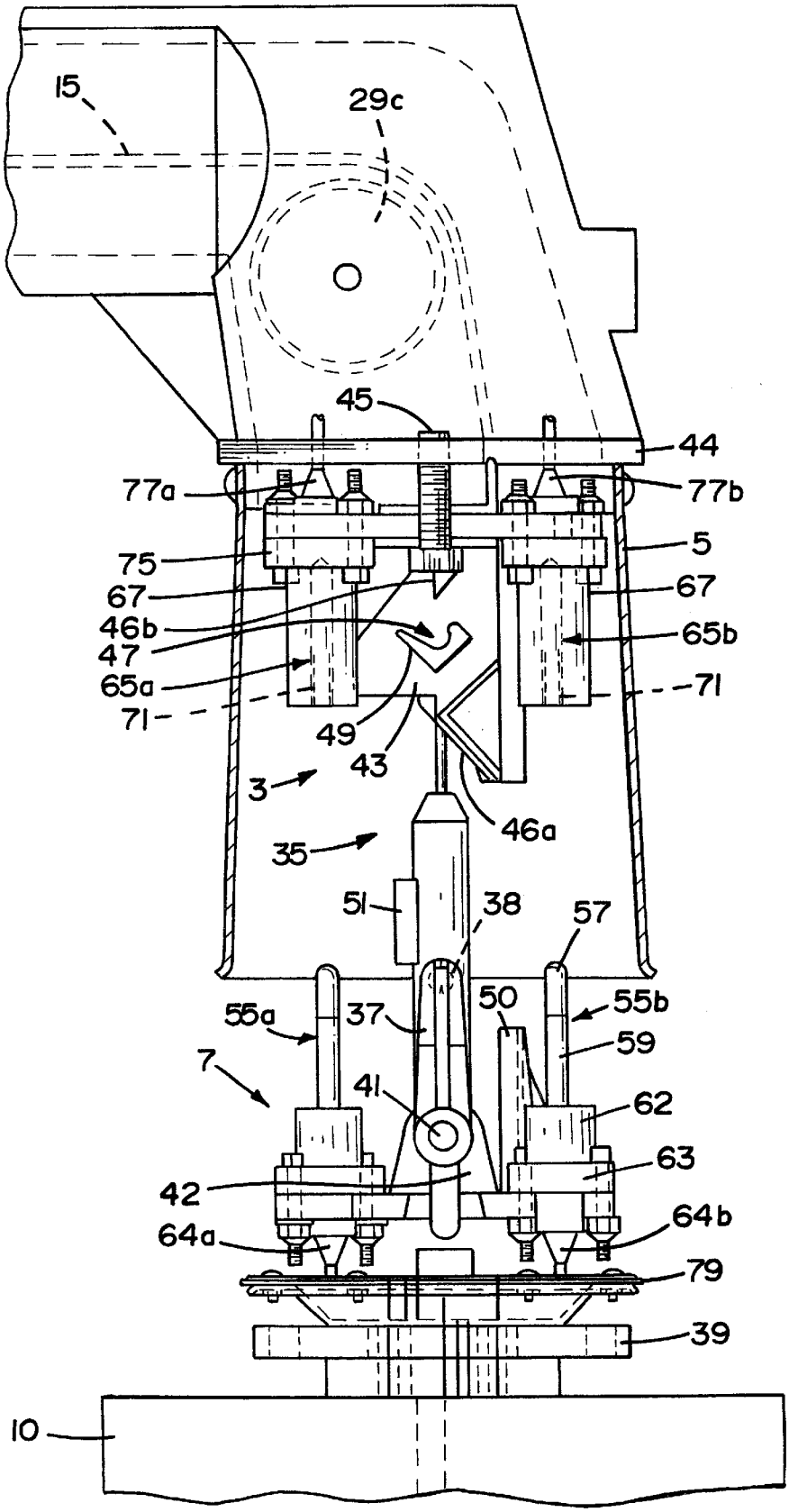
FIG. 2 is an enlargement of the area circled in FIG. 1 illustration how the male and female connectors look immediately after disengagement from one another.

With reference to FIGS. 1 and 2, wherein like numerals designate like components throughout all of the several Figures, the suspension connector assembly 1 generally comprises a female connector 3 mounted at the top end of a stationary, bell-shaped housing 5, and a movable male connector 7. The connector assembly 1 of the invention is particularly adapted for interconnecting a lighting assembly 9 or other device requiring a relatively large amount of electrical power to a power source, although it can also be used to supply electricity to relatively sensitive, low power informational-type electronic devices such as surveillance cameras. Lighting assembly 9 is connected to a weight 10 for pulling the male and female connectors 3,7 apart when disengaging is desired. As is best seen with respect to FIG. 1, the connector assembly 1 is supported by the arm of a mast 11.

A hoisting mechanism 13 allows the lighting assembly 9 and the movable male connector 7 to be raised into a working position (illustrated in phantom) or lowered near the ground to an access position which allows the system operator to perform a maintenance operation, such as the changing of a light bulb. To this end, the hoisting mechanism 13 includes a cable 15 that is connected on one end to the male connector 7, and at the other end to a wench 17. The wench 17 is conventional in structure, having a reel 19 rotatably mounted between a pair of lugs 21 secured onto a base 23 for winding and unwinding the cable 15. The base plate 23 is in turn pivotally connected onto a lower wall of the mast 11 by way of a hinge 25. The hinge 25 allows the wench 17 to be pivoted upwardly from the horizontal position illustrated in FIG. 1 to a storage position within the interior of the mast 11 (whereupon the base plate 23 becomes part of the lower walls of the mast 11). A crank 27 secured to the rotatably mounted reel 19 allows a system operator to wind the combination of the lighting assembly 9 and male connector 7 to either of the two positions illustrated in FIG. 1, while guide rollers 29*a–c* allow the cable 15 to be extended and withdrawn through the hollow interior of the mast 11 with a minimum amount of friction. Four power cables 31 interconnect the female connector 3 with an electrical outlet 33 mounted at the base of the mast 11. Outlet 33 is in turn connected to a power source (not shown) which provides the necessary power to operate the light assembly 9.

Figure 5:
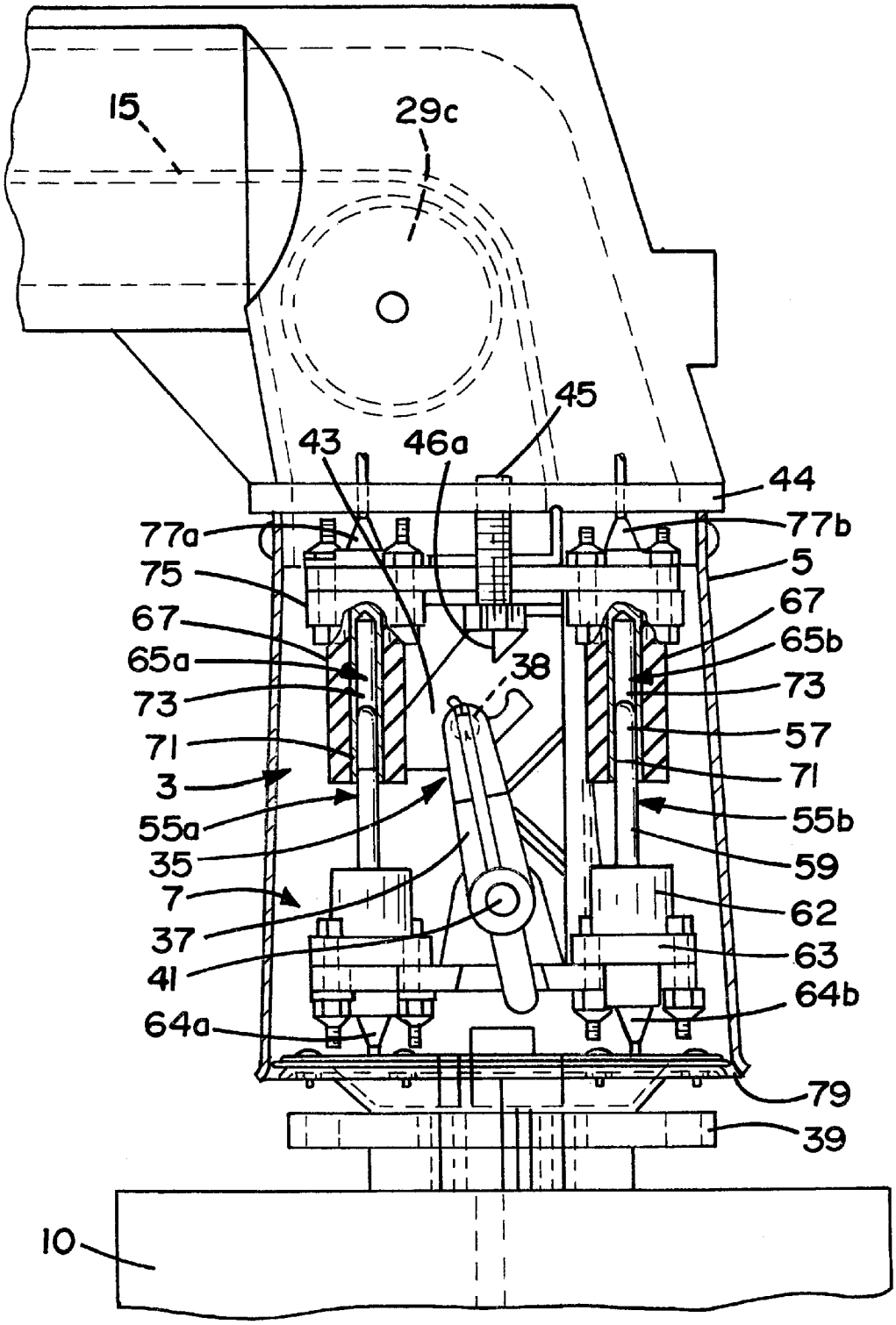
FIG. 5 is a side cross-sectional view of the male connector of the assembly being pulled into engagement with the female connector.

With reference now to FIG. 2, a latching mechanism 35 is provided for mechanically connecting and disconnecting the male connector 7 and the female connector 3. Mechanism 35 includes an elongated latch member 37 having a retaining pin 38 at its distal end. Latch member 37 is pivotally mounted onto a male connector support plate 39 by way of a bolt 41 and lug 42. The female connector 3 includes a latch plate 43 secured to a support plate 44. A mounting bolt 45 secures the female connector support plate 44 to the upper end of the bell-shaped housing 5. Latch plate 43 includes lower and upper ramp-shaped cams 46*a,b* for engaging the retaining pin 38 when the male connector 7 is moved toward the female connector 3. Such cam engagement has the effect of pivotally moving the latch member 37 into latching and unlatching positions, respectively, in a manner which will be described in more detail hereinafter. Plate 43 further includes a latch retainer 47 that also has a cam surface 49 which cooperates with the retaining pin 38 to pivot the latch member 37 into a latching position. Finally, the latching mechanism 35 includes an alignment member 50 and key 51 which not only serves to properly align the latch member 37 with the plate 43, but also registers the pins 55*a–d* of the male connector 7 with the barrels 65*a–d* of the female connector 3 when the male connector 3 and lighting assembly 9 are pulled upwardly from the position illustrated in FIG. 2 to the position illustrated in FIG. 5. In the preferred embodiment, the latching mechanism 35 is the same mechanism used in the Model SCU-2A suspension connector manufactured by Lighting And Lowering Systems located in Chicago, Ill.

Figure 3A:
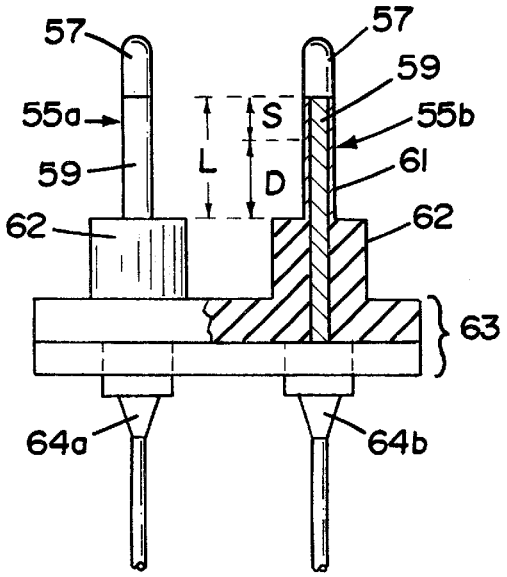
FIGS. 3A and 3B are a partial side, cross-section view and a plan view, respectively, of the female connector drawn without the latching mechanism for simplicity.
Figure 3B:
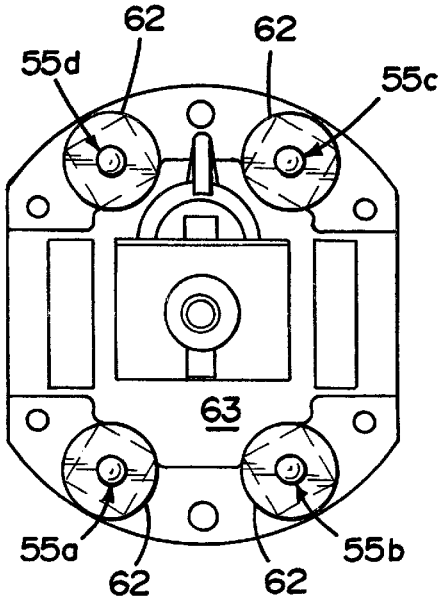

With reference now to FIGS. 3A and 3B, male connector 7 includes four pins 55*a–d*. Each of these pins has a conductive end portion 57, and an insulated, over-travel portion 59 that mechanically connects the conductive end portion 57 with a plug member 62. Each of the over-travel portions 59 is insulated with a thin sleeve 61 of a non-conducting material. In the preferred embodiment, both the sleeve 61 and the plug member 62 are preferably integrally molded from a water, weather, and ozone resistant synthetic rubber, such a chlorosulfonated polyethylene. A synthetic rubber sold under the trademark HYPALON® is an example of such a synthetic rubber. The length L of each over-travel portion 59 is at least as long as the latching stroke distance D required for the latching mechanism 35 to mechanically connect and disconnect the female and male connectors 3,7. In the preferred embodiment, this length L is equal to the aforementioned latching stroke distance D plus the length S of sealing rings 71 disposed in the opening 70 of each of the barrels 65*a–d* of the female connector 3. Each of the plug members 62 that supports the pins 55*a–d* is integrally molded onto the semicircular upper portion of a base 63. Of course, each of the pins 55*a–d* is connected to a wire 64*a–d* (of which only 64*a* and 64*b* are visible) which is ultimately connected to light bulb sockets within the lighting assembly 9. While not specifically shown in the drawings, one of the pins 55*a–d* is longer than the other three and is connected to ground. Such dimensioning results in a significant safety feature as it insures that the ground pin is the first to engage and the last to disengage the female connector 3.

Figure 4A:
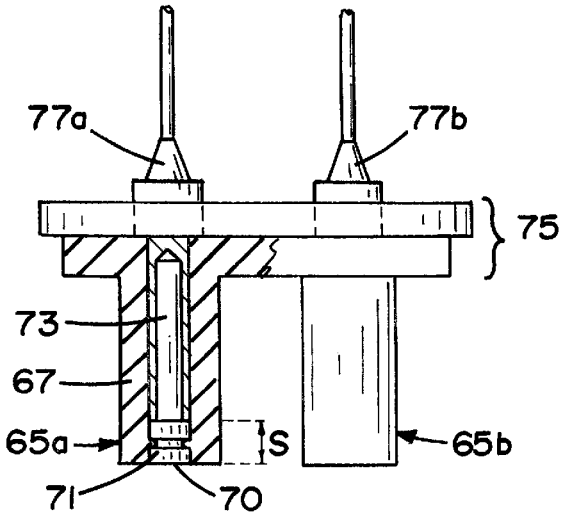
FIGS. 4A and 4B are a partial side cross-sectional view and a plan view, respectively, of the male connector of the invention drawn without the latching mechanism for simplicity.
Figure 4B:
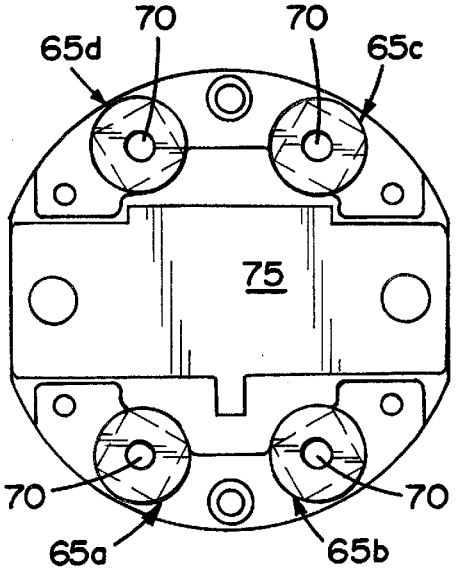

With reference now to FIGS. 4A and 4B, the female connector 7 includes four barrel assemblies 65*a–d*, each of which comprises a plug body 67 formed from an electrically insulating material, such as the water, weather, and ozone resistant synthetic rubber that forms the plug member 62 of the male connector 7. The distal end of each of the plug bodies 67 has a concentrically-located opening 70 for receiving the conductive end portions 57 of the pins 55*a–d*. A pair of in tandem o-ring seals 71 circumscribes the opening 70 as shown. Immediately behind the o-ring seals 71 is a resilient barrel 73 for gripping the conductive end portion 57 of each of the pins 55*a–d*. While not specifically shown in the drawings, each of the resilient barrels 73 includes a longitudinally slotted inner barrel formed from an alloy of copper which is circumscribed by a sleeve of spring metal. Because the barrels 73 are integrally molded into the plug bodies 67, and because the plug bodies 67 are formed from a resilient synthetic rubber, the plug bodies 67 lend an extra measure of resilient reinforcement to the inner, electrically conducting sleeves within each of the barrels 73. Each of the plug bodies 67 is integrally molded into an upper, half-moon shaped plate of a base 75. Wires 77*a–d* (of which only 77*a* and 77*b* are visible) connect the barrel 73 of each of the barrel assemblies 65*a–d* to the conductive wires 31 shown in FIG. 1. As is illustrated in FIGS. 2 and 5–7, a neoprene sealing ring 79 is mounted immediately behind the barrel assemblies 65*a–d* of the female connector 3 in order to seal out moisture and debris from the bell-shaped housing 5 when the female and male connectors 3, 7 are engaged in the position illustrated in phantom in FIG. 1.

The operation of the invention may best be understood with respect to FIGS. 1, 2, 5, 6, and 7. When the maintenance operator wishes to reconnect the male connector 7 to the female connector 3 from the position illustrated in FIG. 1, he turns the crank 27 of the reel 19 so that the cable 15 pulls the male connector 7 into the position illustrated in FIG. 2. He continues to turn the crank 27 until the key 51 and alignment member 50 slide into latch plate 43 to align the male pins 55*a–d* with the opening 70 of the female barrel assemblies 65*a–d*. At this juncture, the retaining pin 38 of the latch member 37 engages ramp-shaped cam surfaces 46*a* and 49, thereby pivoting the latch member 37 counterclockwise in the position illustrated in FIG. 5. The maintenance operator continues to turn the crank 27 until the male connector 7 is fully engaged against the female connector 3 in the position illustrated in FIG. 6. In this position, the pins 55*a–d* are fully inserted into the resilient barrel 73 of each barrel assembly 65*a–d*. Additionally, the faces of the plug members 62 of the male connector 7 are engaged against the faces of the plug bodies 67 of the female barrel assemblies 65*a–d*. Because the latch member 37 is resiliently biased into the vertical position illustrated in FIG. 2, it pivots clockwise back into this position so that the retaining pin 38 is disposed directly over the V-shaped interior of the latch retainer 47. The maintenance operator then releases the crank 27 whereupon the weight 10 of the lighting assembly 9 pulls the entire male connector 7 downwardly a latch stroke distance D until the retaining pin 38 of the latch member 37 engages the latch retainer 47. When the male connector 7 is so situated, the resilient, electrically conductive barrels 73 of each of the barrel assemblies 65*a–d* circumscribe and grip the conductive end portion 57 of each of the male pins 55*a–d*, while the o-ring seals 71 circumscribe the upper end of the insulated over-travel portions 59 of these pins 55*a–d*. Hence, a secure electrical connection is created between the pins 55*a–d* and the barrel assemblies 65*a–d* which is completely electrically insulated by virtue of the insulating sleeve 61 surrounding the over-travel portions 59 of each of the pins 55*a–d*. Moreover, the resulting connection is waterproof due to the sealing engagement between the o-ring seals 71 and the upper ends of the insulated over-travel portions 59.

It should be noted that the dimensioning of the length of the overtravel portion 59 of each of the male pins 55*a–d* is directly responsible for the aforementioned secure and insulated connection between the connectors 3 and 7. Because each of the over-travel portions 59 has a length L which is equal to the length D of the latch stroke distance, plus the length S of the two, in tandem o-ring seals 71, and because the combined length of the o-rings 71 and the resilient barrels 73 is the same as the length L of each of the male pins 55*a–d*, the invention is capable of achieving a safe and secure electrical connection every time the female and male connectors 3 and 7 are engaged, while simultaneously accommodating the reciprocal stroke movement necessary for the latching mechanism 35 to mechanically engage and disengage the connectors 3 and 7 from one another.

Figure 6:
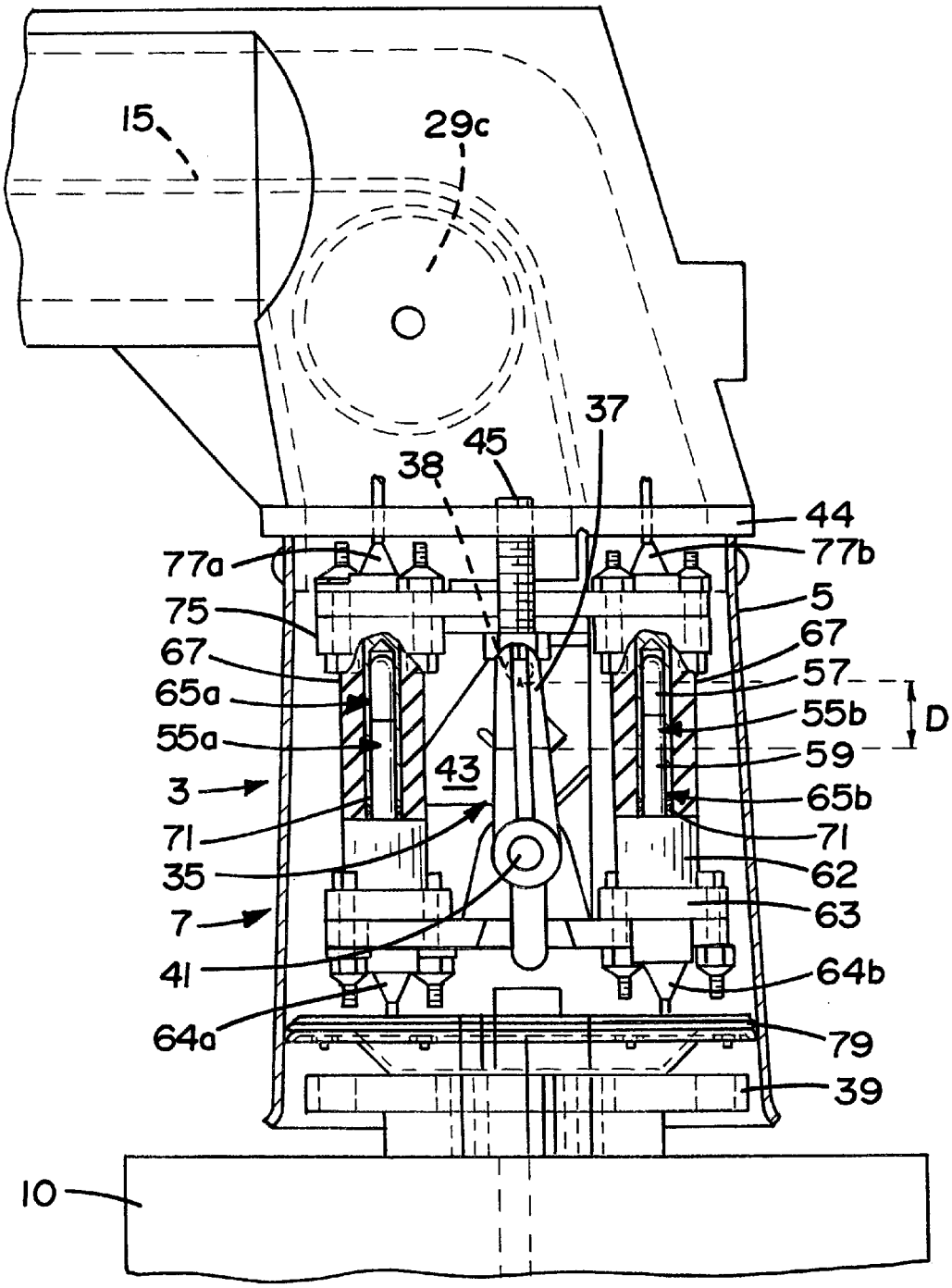
FIG. 6 is a side cross-sectional view of the male connector in engagement with the female connector in order to activate the latching mechanism of the assembly.
Figure 7:
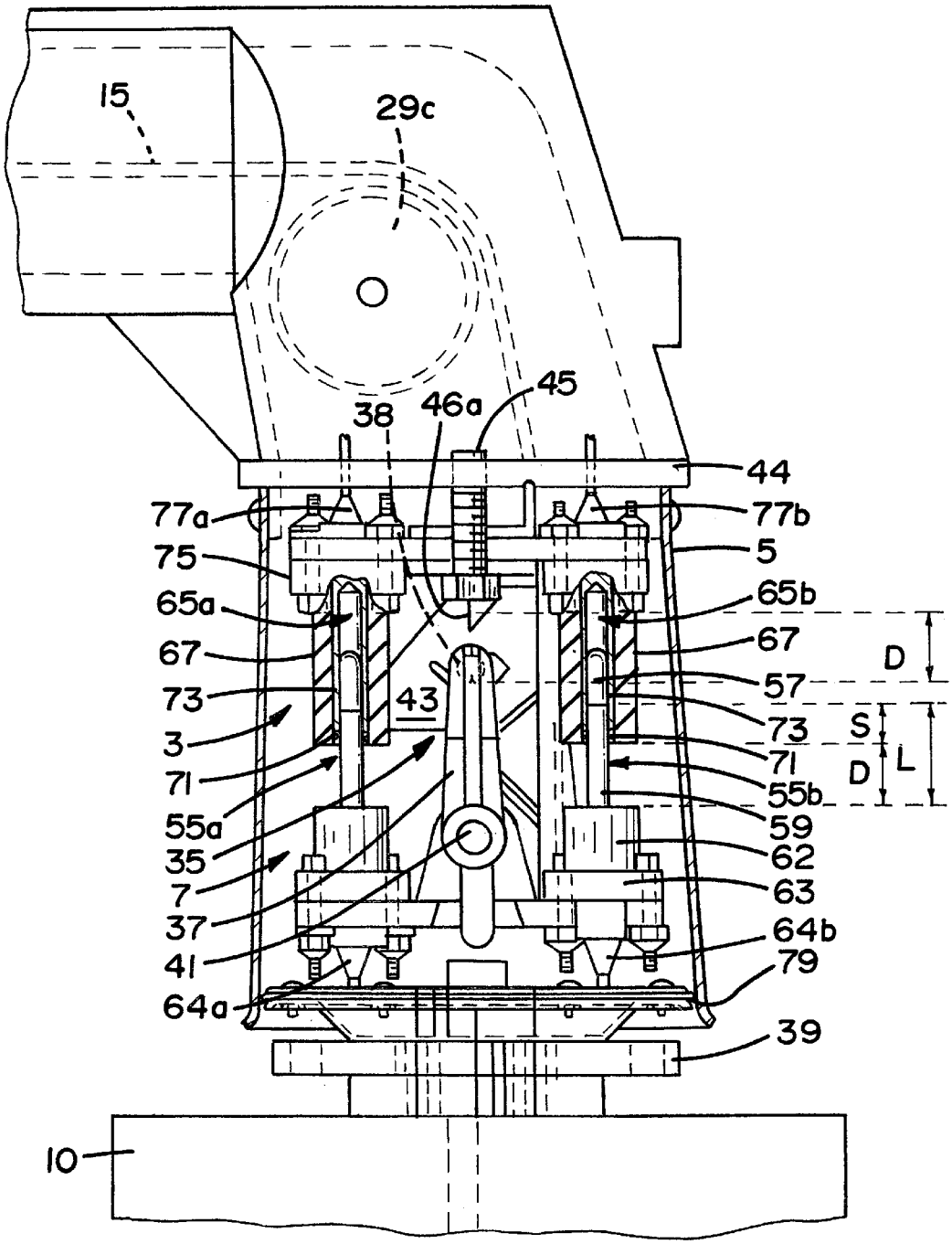
FIG. 7 is a side cross-sectional view of the male and female connectors of the assembly interconnected by the latching mechanism after the male connector has fallen downwards a latching stroke distance D.

When the maintenance operator wishes to disengage the two connectors 3 and 7, he turns the crank 27 of the reel 19 to re-engage the connectors 3 and 7 from the position illustrated in FIG. 7 to the position illustrated in FIG. 6. As such re-engagement occurs, the retaining pin 38 engages the ramp-shaped surface 46*a*, thereby pivoting the latch member 37 in a clockwise direction with the retaining pin 38 clearing the V-shaped surface of the latch retainer 47. The maintenance operator then reverses the direction of the crank 27 of the reel 19 so as to unwind the cable 15, which allows the weight 10 of the lighting assembly 9 to pull the male pins 55*a–d* from the female barrel assembly 65*a–d*. The lighting assembly 9 is then free to fall back into the position illustrated in FIG. 1 for a maintenance operation to be performed. Even though this invention has been described in the context of a single preferred embodiment, various modification and additions will become evident to persons of skill in the art. All such variations, modifications, and additions are encompassed within the scope of this invention, which is limited only by the claims appended hereto.

What is claimed:

1. A suspension connector assembly comprising:

a female connector mounted within a stationary housing and including an electrical contact member disposed within an electrically insulative plug body;

a movable male connector adapted to be raised toward and lowered away from said female connector and including a contact member having a conductive end portion insertable within said female contact element, and a latching mechanism for joining said female and male connectors when said connectors are mutually engaged and said male connector falls away from said female connector a latch stroke distance, wherein said contact member includes an electrically insulated over-travel portion for maintaining said conductive end portion within said female contact element after said male connector falls away from said female connector said latch stroke distance.

2. The suspension connector assembly defined in claim 1, wherein said electrically insulative plug body also insulates said female contact element from ambient air and moisture.

3. The suspension connector assembly defined in claim 2, wherein said electrically insulative plug body includes an opening for receiving said contact member, and a seal surrounding said opening for sealing out ambient air and moisture when said contact member is disposed within said opening.

4. The suspension connector assembly defined in claim 1, wherein said female contact element is a conductive barrel, and said male contact member is a pin resiliently insertable within said barrel.

5. The suspension connector assembly defined in claim 1, wherein said over-travel portion of said contact member is substantially the same length as said latch stroke distance.

6. The suspension connector assembly defined in claim 1, wherein said female connector includes a plurality of electrical contact elements, and said male connector includes a plurality of contact members registrable with and insertable within said female contact elements.

7. The suspension connector assembly defined in claim 1, wherein said female plug body is integrally formed from a synthetic rubber.

8. The suspension connector assembly defined in claim 1, wherein said over-travel portion of said contact member is electrically insulated by synthetic rubber.

9. The suspension connector assembly defined in claim 1, wherein said male connector includes a plug member formed from an electrically insulative material for supporting said male contact member, and said over-travel portion of said contact member is insulated by a layer of the same insulative material that forms said plug member.

10. The suspension connector assembly defined in claim 1, further comprising means for aligning said male contact member with said female contact element when said male connector approaches said female connector for engagement.

11. A suspension connector assembly, comprising:

a female connector mounted within a stationary housing including an electrical contact element, and an electrically insulative plug body surrounding and resiliently supporting said contact element;

a movable male connector adapted to be raised toward and lowered away from said female connector and including a contact member having a conductive end portion insertable within said female contact element, and an insulative plug member for supporting said contact member, and a latching mechanism for joining said female and male connectors when said connectors are mutually engaged and said male connector falls away from said female connector a latch stroke distance, wherein said contact member includes an electrically insulated over-travel portion for maintaining said conductive end portion within said female contact element after said male connector falls away from said female connector said latch stroke distance, wherein said over-travel portion of said contact member is substantially the same length as said latch stroke distance.

12. The suspension connector assembly defined in claim 11, wherein said electrically insulative plug body includes an opening for receiving said contact member, and a seal surrounding said opening for sealing out ambient air and moisture when said contact member is disposed within said opening.

13. The suspension connector assembly defined in claim 11, wherein said female contact element is a conductive barrel, and said male contact member is a pin resiliently insertable within said barrel.

14. The suspension connector assembly defined in claim 11, wherein said over-travel portion of male plug member is formed from an electrically insulative material, and said male contact member is insulated with the same material forming said male plug member.

15. The suspension connector assembly defined in claim 14, wherein said male plug member is formed from a synthetic rubber, and said over-travel portion of said male contact member is insulated by a sleeve of said rubber integrally formed with said plug member.

16. The suspension connector assembly defined in claim 11, wherein said female connector includes a plurality of electrical contact elements, and said male connector includes a plurality of contact members registrable with and insertable within said female contact elements.

17. The suspension connector assembly defined in claim 11, further comprising means for aligning said male contact member with said female contact element when said male connector approaches said female connector for engagement.

* * * * *